US006909373B2

(12) United States Patent
Power et al.

(10) Patent No.: US 6,909,373 B2
(45) Date of Patent: Jun. 21, 2005

(54) FLOOR MONITORING SYSTEM

(75) Inventors: Michael William Power, St. Peter's Bay (CA); Graham Atkin, Halifax (CA); Bruce Mac Donald, Timberlea (CA)

(73) Assignee: Vitrak Wireless Inc., St. Peter's Bay (CA)

( * ) Notice: Subject to any disclaimer, the term of this patent is extended or adjusted under 35 U.S.C. 154(b) by 0 days.

(21) Appl. No.: 10/434,195

(22) Filed: May 9, 2003

(65) Prior Publication Data

US 2004/0222896 A1 Nov. 11, 2004

(51) Int. Cl.[7] ..... G08B 21/00

(52) U.S. Cl. ..... 340/665; 340/666; 323/904; 343/853; 343/893; 345/173

(58) Field of Search ..... 340/666, 667, 340/665, 551, 552, 562, 565, 572.1, 572.2, 572.4, 572.6, 572.7, 572.8; 323/904; 345/173, 179; 324/236; 343/893, 853

(56) References Cited

U.S. PATENT DOCUMENTS 4,430,645 A * 2/1984 Eskandry et al. ..... 340/572.2
4,555,696 A * 11/1985 Brown ..... 340/551
6,498,590 B1 * 12/2002 Dietz et al. ..... 343/893
6,563,423 B2 * 5/2003 Smith ..... 340/572.1

FOREIGN PATENT DOCUMENTS

| | | | |
|---|---|---|---|
| CA | 2324967 | 5/2002 | ..... H05C/3/00 |
| DE | 19923280 | 5/1999 | ..... G07C/11/00 |
| GB | 2349728 | 3/2000 | ..... G07C/9/00 |
| NL | 9100591 | 4/1991 | ..... G01L/1/16 |

* cited by examiner

*Primary Examiner*—Davetta W. Goins

(57) ABSTRACT

The invention discloses a system including floor tiles for monitoring the movements of individuals across a floor surface. The system is comprised of a plurality of floor tiles electrically and mechanically interconnected. The floor tiles are monitored to determine where, when and how weight is applied to the floor tiles. The system may also comprise an identification system comprising individual transmitters and a receiver. The receiver is tied into the tile monitoring system to allow the identification of an individual on the floor surface.

21 Claims, 7 Drawing Sheets

FLOOR MONITORING SYSTEM

FIELD OF THE INVENTION

The present invention relates to a system for monitoring the identity of individuals stepping onto a floor surface and movement of such individuals across the floor surface.

BACKGROUND OF THE INVENTION

Monitoring systems for tracking the movement of persons are known.

For example, commonly owned pending Canadian Patent Application No. 2,324,967 is directed to a system for monitoring the location of an individual relative to one or more detectors. The system uses a transmitter worn by a person, which emits an identification signal which is picked up by a detector located at a monitoring station. The detectors are capable of identifying the particular individual as well as their distance from the detector. Such systems are limited in that they provide only the location of the individual relative to the detector.

Floor monitoring systems are also known. The known floor monitoring systems use pressure gauges to detect when weight is placed on the floor.

SUMMARY OF THE INVENTION

According to a broad aspect of the invention there is provided a floor monitoring tile comprising: a contact layer having an upper surface and a lower surface, the lower surface having a plurality of conductive contacts; a sensor layer having a plurality of first conductors and a plurality of second conductors, each first conductor having a plurality of first contact points and each second conductor having a plurality of second contact points, for each contact a respective first contact point of said first plurality of contact points and a respective second contact point of said second plurality of contact points forming a set being aligned with the contact; wherein for each contact, when no force is applied to the contact, the respective first contact point and the respective second contact point remain electrically isolated and when force is applied to the contact, the respective first contact point and the respective second contact point electrically connect through the contact.

According to another aspect of the invention there is provided a system for monitoring the movements of at least one individual across a floor surface comprising: a plurality of floor tiles; the floor tiles each having an upper surface, a contact layer, a sensor layer and a detector; the contact layer having a plurality of conductive contacts; and the sensor layer comprising a plurality of pairs of contact points which are electrically connected by the conductive contacts of the contact layer when force is applied normal to the contact points; wherein the detector calculates an area of the floor tile over which the force is applied as a function of time.

The present invention provides a monitoring and identification system which is capable of tracking the movement of individuals across a floor surface including the measurement of their gait, speed, direction, footprint geometry or volume and how each foot contacts the floor. The monitoring system may also provide the person's identity and link their movement pattern to stored historical information.

An advantage of the present invention in some embodiments is that it provides significantly more information than conventional monitoring systems.

BRIEF DESCRIPTION OF THE DRAWINGS

Embodiments of the present invention will be further described with reference to the accompanying drawings, in which.

DETAILED DESCRIPTION OF THE PREFERRED EMBODIMENTS

Conventional systems do not identify the individual's exact location. They also do not provide information regarding how the individual is moving across the floor surface including gait, speed, direction, footprint geometry and how each foot contacts the floor. In many applications it would be useful to have detailed information about how a person is moving. In medical applications, that information can be used to assess the individual's progress towards recovery from an illness. Equally, in security applications, the information can be used to assess whether an individual is engaged in prohibited activities. In scientific applications, that information can be used to understand the gait of animals such as horses and dogs.

Figure 1:
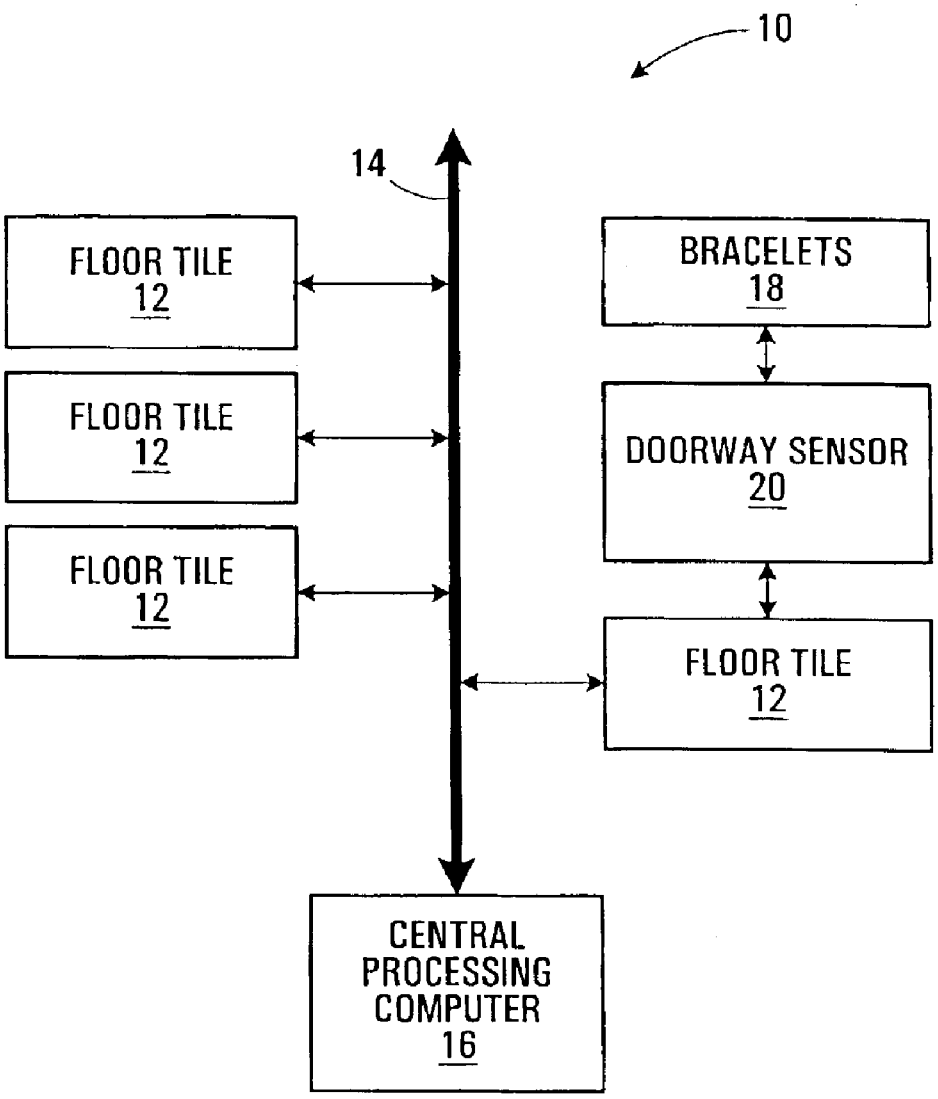
FIG. 1 is a block diagram of a preferred embodiment of the floor monitoring system of the present invention.

Referring to FIG. 1, a floor monitoring system generally indicated by 10 is comprised of a plurality of floor tiles 12 (only four shown), a data bus and power supply 14 and a central processing computer 16. The floor tiles 12 are mechanically interconnected to form a floor surface. The floor tiles are also electrically interconnected by the data bus and power supply 14. The data bus and power supply 14 interconnect both the floor tiles 12 to each other and to the central processing computer 16. Each floor tile 12 also has a unique identification which is communicated to its nearest neighbour for configuration purposes.

The system also includes bracelets 18 and at least one doorway sensor 20. The bracelets 18 are worn by the individuals to be monitored. Instead of the bracelet 18, a broach, necklace, other personal accessory, a swipe card or an implant may be employed. In the case of a swipe card, the doorway sensor 20 is replaced by a card reader.

Each of the bracelets 18 emits a unique identity signal, preferably a radio frequency signal. Each bracelet 18 is configured to allow the doorway sensor 20 to receive and retransmit, to one of the floor tiles 12, the identity signal of each bracelet 18 when it is within the range of the doorway sensor 20. The range of the doorway sensor is preferably at least one meter but other ranges can be employed. The doorway sensor 20 does not necessarily need to be positioned in a doorway and multiple doorway sensors 20 may be positioned around the floor surface. Preferably the doorway sensor 20 is electrically connected to a floor tile 12 which receives identity information and communicates that information to the central processing computer 16.

In security applications, swipe cards can be used. The floor tiles 12 are positioned before the card reader. When the swipe card is read by the card reader, the information registered by the floor tiles 12 is compared to historical information. A card holder is permitted to advance only if the data matches.

Although the bracelets 18 provide identity information, in another embodiment, the floor monitoring system 10 operates without the use of the bracelets 18. The floor monitoring system 10 will then provide information regarding the movement of individuals but will not directly indicate the identity of the individual being tracked although it may be possible to derive the individual's identity based on the information provided by the floor tiles 12. The central processing computer 16 will determine the identity of the individual using the signals generated by the floor tiles.

Figure 2:
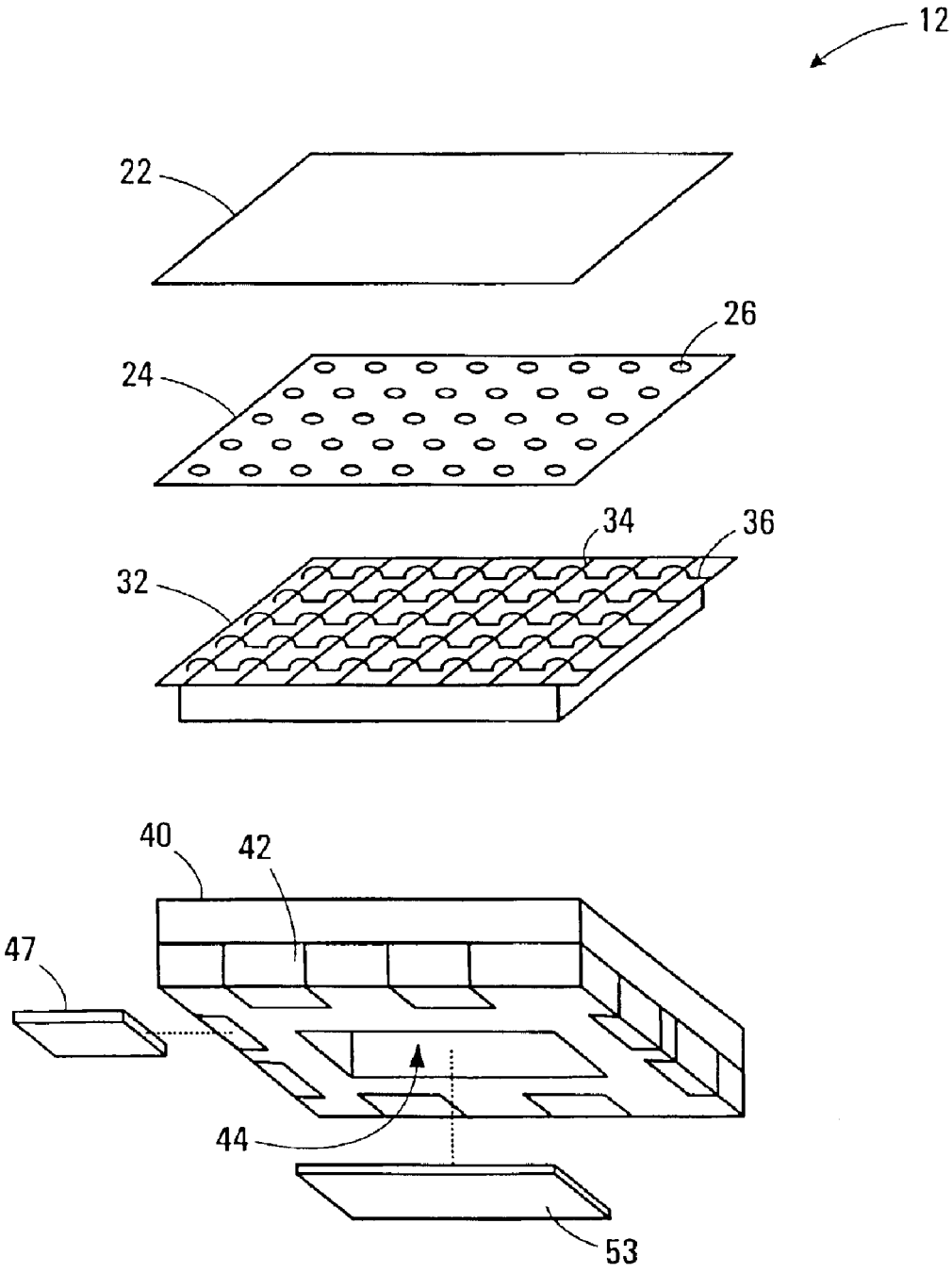
FIG. 2 is an exploded view of a floor monitoring tile according to a preferred embodiment of the present invention.

FIG. 2 depicts the various layers which make up each floor tile 12. The layers of the tiles consist of a surface layer 22, contact layer 24, sensor layer 32 and tile base 40. Preferably, the floor tiles 12 have an area of two feet by two feet and a thickness of two centimetres or less but more generally any suitable dimensions can be employed. The surface layer 22 is the upper surface of the tile with which an individual's feet may contact. An alternative embodiment of the invention would allow the floor tiles 12 to be assembled without the surface layer 22 and a sheet of flooring to be laid over the entire surface of all of the floor tiles 12 of the floor surface. However, the preferred embodiment of this invention provides complete individual floor tiles 12 with the individual surface layer 22. The material used for the surface layer 22 must readily flex when stepped on but must spring back to its original shape when weight is removed from the layer. The preferred material identified for this aspect of the invention is styrene butadiene rubber which is also known as synthetic rubber. This material flexes and quickly returns to its original shape when repeatedly loaded by footprints. The material used for the contact surface also preferably allows for the application of labelling, is not damaged by cleaning, is wear-resistant, slip-resistant and comfortable to the sense of touch.

Figure 3A:
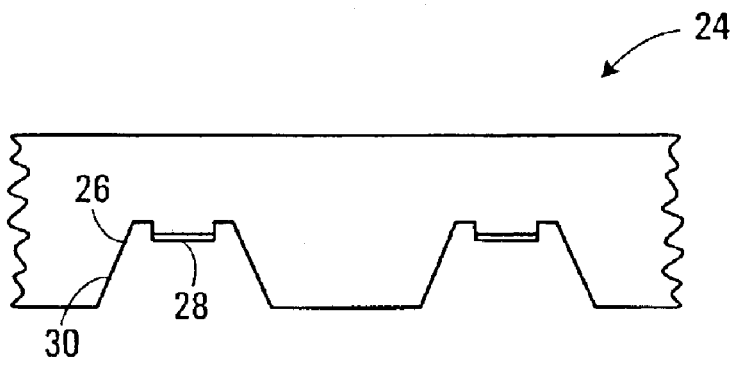
FIG. 3A is a cross sectional view of a portion of a contact layer.

The next layer is the contact layer 24 which has a plurality of dimples 26 defined therein which are used to form contacts. Means other than dimples may also be used to form the contacts. The dimples 26 are preferably on a grid of 128 by 128 resulting in a total number of dimples of 16,384 dimples 26 per each floor tile 12. The dimples 26 are shown in further detail in cross-section in FIG. 3A. FIG. 3A shows that each dimple 26 has vertically angled sides 30 and a contact area 28. Preferably, the contact layer 24 is comprised of thermal formable foam compound and in particular polyolefin which is known for sub-flooring applications. The contact areas 28 are formed on the bottom side of the contact layer 24. Preferably, the contact areas 28 comprise resistive paint, which is sprayed onto the dimples though a screen such that the contact areas 28 are electrically isolated from each other. In some embodiments, the conductive paint on the contact layer has an effective resistance of 22 kohms. In an alternative embodiment, the contact areas 28 have minimal resistance and separate resistors are provided on the contact layer 24 or the sensor layer 32. Preferably, all resistance values are equal.

Figure 3B:
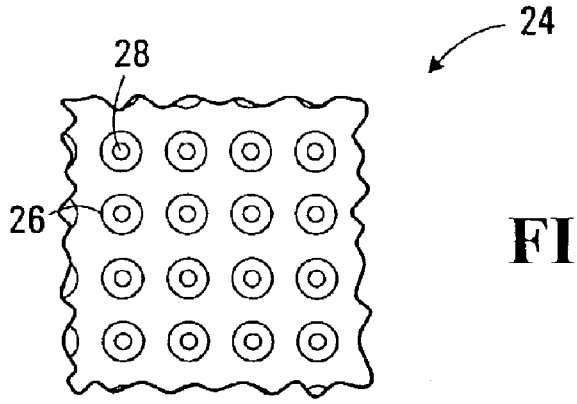
FIG. 3B is a schematic plan view of a portion of a contact layer.
Figure 3C:
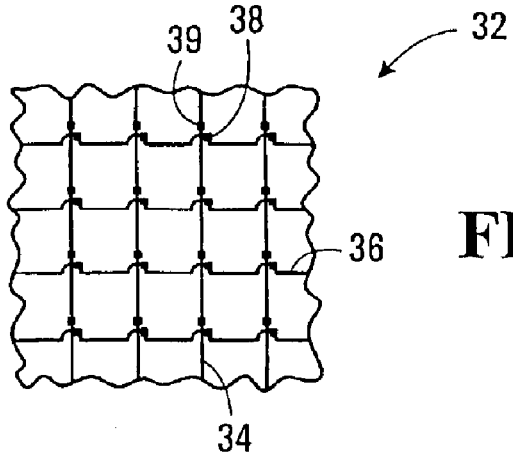
FIG. 3C is a schematic plan view of a portion of a sensor layer of a preferred embodiment of the present invention.

Referring now to FIG. 3C, below the contact layer 24 is the sensor layer 32 which comprises four quarter contact panel printed circuit boards (QCP boards) 96 (FIG. 5 and FIG. 6) having at least two layers shown schematically in FIG. 3C as a unitary board. In combination, the four QCP boards 96 provide columns of conductors 34 extending from one edge of the floor tile 12 to an opposite edge. Rows of conductors 36 extend perpendicularly to the columns of conductors 34. Columns of conductors 34 and rows of conductors 36 are formed on separate layers of the QCP boards 96 such that they are normally electrically isolated.

FIGS. 3B and 3C show a partial schematic plan view of the contact layer 24 and sensor layer 32. Contact points 39 for columns of conductors 34 and contact points 38 for rows of conductors 36 are exposed on the upper surface of the sensor layer 32 adjacent the overlapping points of the columns of conductors 36 and rows of conductors 34. The dimples 26 each overlay an adjacent pair of the contact points 38, 39.

The last layer of the floor tile 12 is the tile base 40. The tile base 40 contains a cavity 44 for receiving a central processing unit printed circuit board (CPU board) 53 for each floor tile 12. Each of the four QCP boards 96 interconnects one quadrant of the sensor layer to the CPU board 53. The electrical operation of the system is described in more detail below. The tile base 40 also contains slots 42 for receiving connectors 47 (one shown). The connectors 47 preferably both mechanically and electrically interconnect the floor tiles 12. In one embodiment the connectors 47 are rectangular and are placed on the floor surface first with the floor tiles 12 fitting over and mating with the connectors 47.

The four layers depicted in FIG. 2, namely the surface layer 22, the contact layer 24, the sensor layer 32 and the tile base 40 are connected as follows. The four QCP boards which make up the sensor layer 32 are screwed to the tile base 40. The contact layer 24 is glued to the sensor layer 32 and the surface layer 22 is glued to the contact layer 24.

In operation, when a footstep load is put on the surface layer 22, this load is transmitted to the contact layer 24. When the dimples 26 are depressed, the vertically angled sides 30 of the dimples 26 collapse under the load bringing the contact areas 28 into electrical contact with corresponding pairs of contact points 38, 39. The contact area 28 creates an electrical connection between the pair of contact points 38, 39 which underlie the dimple 26 thereby connecting the conductor column 34 to the conductor row 36. When the load is removed, the dimples 26 spring back to their former shape releasing the connection between the pair of contact points 38, 39.

The making and removal of connections by the dimples 26 and the pairs of contact points 38, 39 are used to determine where and how a footstep falls on the floor tiles 12. In order to determine which pairs of contact points 38, 39 have been electrically connected by the dimples 26, it is necessary for the CPU board 53 to continually scan the contact points 38 and the contact points 39 to determine where a connection has been made. In one embodiment, the CPU board 53 scans all the contact points sixty times per second and transmits this contact information back to the Central Processing Computer 16 every cycle. The dimples 26 have each been given a resistive aspect.

Figure 4A:
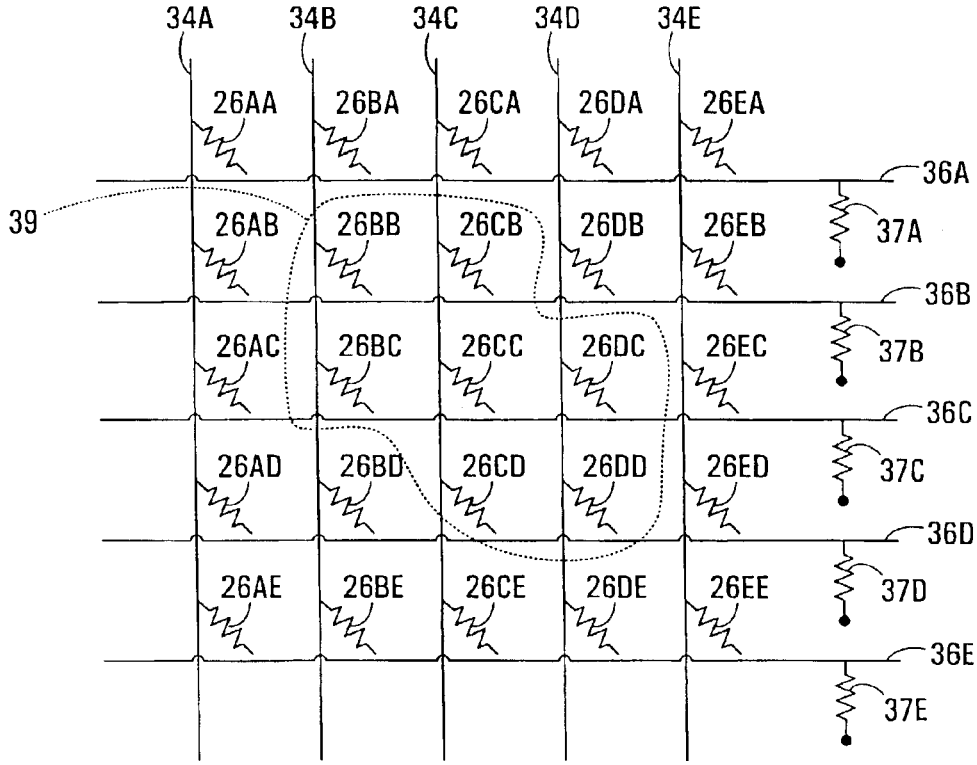
FIG. 4A is an electrical schematic of a portion of the contact and sensor layers according to a preferred embodiment of the present invention.
Figure 4B:
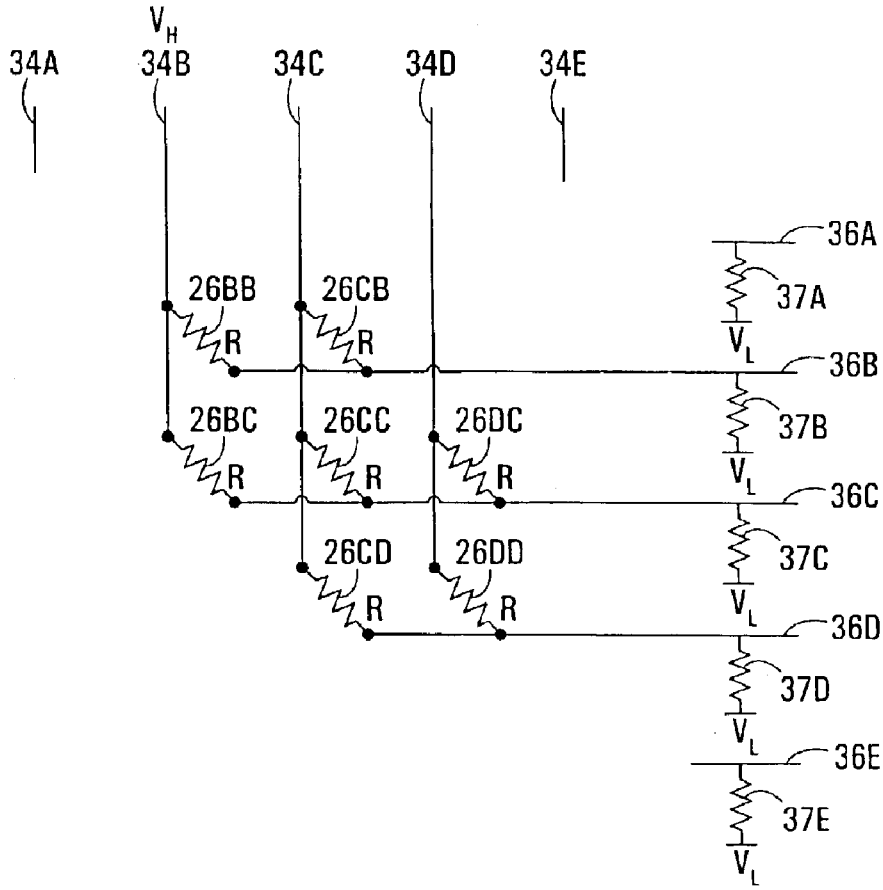
FIG. 4B is an electrical schematic of a circuit which results when a portion of the dimples depicted in FIG. 4A are depressed.
Figure 4C:
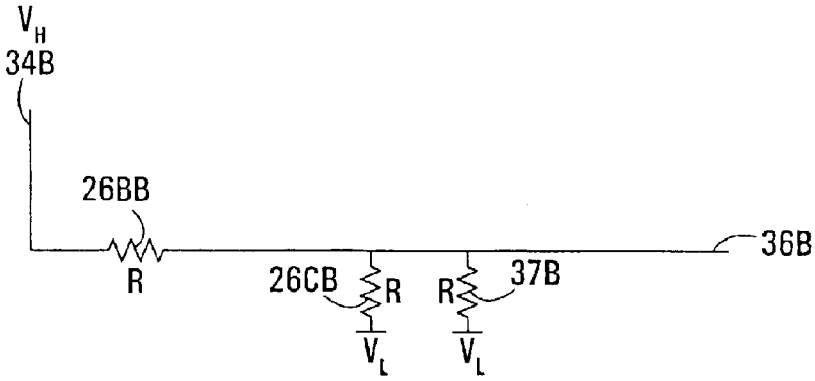
FIG. 4C is an electrical schematic of a circuit which results when a conductor column depicted in FIG. 4B is set high.

FIGS. 4A, 4B and 4C depict schematically how the resistive aspect of each dimple 26 acts to allow the detection of which dimples 26 are depressed. FIG. 4A depicts five exemplary rows of conductors 36, identified as conductor row 36A to 36E. Each row has a pull down resistor 37, identified as pull down resistor 37A to 37E. Also depicted in FIG. 4A are five exemplary columns of conductors 34, identified as 34A to 34E. Twenty-five dimples 26 which interconnect pairs of contact points 38,39 (not shown), are identified as 26AA to 26EE. The resistive value of each dimple 26 is preferably the same as the resistive value of the pull down resistors 37. In a particular example, the resistance might be 22 kohms, with 64 columns and 64 rows of conductors on each QCP board.

The process of detecting which dimples 26 are depressed is conducted by setting each conductor column 34A to 34E to a high voltage in turn and then measuring the voltage of each conductor row 36A to 36E in turn. Thus, conductor column 34A is first set to a high voltage $V_H$, for example 5V, and conductor columns 34B to 34E and conductor rows 36A to 36E are pulled low to voltage $V_L$, for example 0V. The voltage of each conductor row 36A to 36E is then measured. Next conductor column 34B is set to a high voltage and conductor columns 34A, 34C to 34E and conductor rows 36A to 36E are pulled low. The voltage of each conductor row 36A to 36E is again measured. The same process is repeated for the remainder of the conductor columns 34C to 34E. The measurement of each conductor row 36 against each conductor column 34 constitutes one complete scanning cycle which is again repeated. Each scanning cycle will provide a map of where a foot is positioned on the floor tile 12 as a function of time. The values of the voltages measured on the conductor rows collectively allow a determination of exactly which dimples are pressed. This is because, due to the resistances of the dimples and the pull down resistors on the rows, a different circuit forms for any given set of dimple depressions.

FIG. 4A depicts an exemplary footstep 39. The footstep 39 depresses dimples 26BB, 26BC, 26CB, 26CC, 26CD, 26DC and 26DD. FIG. 4B depicts the resulting circuit diagram showing the interconnections between rows and columns. All of the rows are pulled low to voltage $V_L$ through respective pull down resistors. All but one of the columns are also pulled low. The scanning process detects the depression of the dimples as follows:

a) Conductor column 34A is set to high $V_H$ and the remaining conductor columns and rows are pulled low. The voltage of each conductor row 36A to 36E is measured. Since none of the dimples 26 of conductor column 34A are depressed, all the conductor rows 36A to 36E measure low voltage.

b) Conductor column 34B is then set high and the remaining conductor columns and rows are pulled low. The voltage of conductor row 36A is measured low since dimple 26BA is not depressed.

The circuit which exists when conductor column 34B is connected to $V_H$, and conductor row 36B is measured, is shown in FIG. 4C. The voltage of conductor row 36B will not measure low. The dimple 26BB connects conductor column 34B to conductor row 36B. Conductor row 36B is in turn connected to conductor column 34C by dimple 26CB. Conductor column 34C is, as noted above, pulled low and acts in the same way as the pull down resistor 37B. Thus the voltage on conductor row 36B sees the resistance of dimple 26BB in series with the resistances of dimple 26CB and pull down resistor 37B in parallel. More generally, the row will see the resistance of the vertical column's dimple, in series with a parallel combination of all dimple resistances which are connected in the row, and the pull down resister.

The voltage of conductor row 36C is similarly affected. The voltage on conductor row 36C sees the resistance of dimple 26BC in series with the resistances of dimples 26CC and 26DC and pull down resistor 37C which are in parallel.

The voltage of conductor rows 36D and 36E are measured low since dimples 26BD and 26BE are not depressed.

c) Conductor column 34C is next set high and the remaining conductor columns and rows are pulled low. The voltages of conductor rows 36A and 36E are again measured low since dimples 26CA and 26CE are not depressed.

The voltage of conductor row 36B will not measure low. The dimple 26CB connects conductor column 34C to conductor row 36B. Conductor row 36B is in turn connected to conductor column 34B by dimple 26BB. The voltage on conductor row 36B sees the resistance of dimple 26CB in series with the resistances of dimple 26BB and pull down resistor 37B in parallel.

The voltage of conductor row 36C and 36D are similarly affected. The voltage on conductor row 36C sees the resistance of dimple 26CC in series with the resistances of dimples 26BC and 26DC and pull down resistor 37C which are in parallel. The voltage on conductor row 36D sees the resistance of dimple 26CD in series with the resistances of dimple 26DD and pull down resistor 37D which are in parallel.

d) Conductor column 34D is next set high and the remaining conductor columns and rows are pulled low. The voltage of conductor rows 36A, 36B and 36E are measured low since dimples 26DA, 26DB and 26DE are not depressed.

The voltage of conductor row 36C will not measure low. The dimple 26DC connects conductor column 34D to conductor row 36C. Conductor row 36C is in turn connected to conductor columns 34B and 34C by dimples 26BC and 26CC, respectively. The voltage on conductor row 36C sees the resistance of dimple 26DC in series with the resistances of dimples 26BC and 26CC and pull down resistor 37C which are in parallel.

The voltage of conductor row 36D is similarly affected. The voltage on conductor row 36D sees the resistance of dimple 26DD in series with the resistances of dimple 26CD and pull down resistor 37D which are in parallel.

e) All conductor rows 36A to 36E measure a low voltage when conductor column 34E is set high since none of dimples 26EA to 26EE are depressed.

The benefit of resistive values is that a depressed dimple does not affect the voltage reading on other rows as they would without the resistive values. That is, the dimples that connect a row being measured to a column that is being pulled low simply pull the row to ground through another route. This configuration ensures that depressed dimples in the non-scanned column do not affect, or "bleed", to neighbouring lines—the only time a non-zero voltage will occur on a given row is under the following condition: the dimple positioned at the intersection of the scanning column and the particular row is depressed—other depressed dimples in the same row simply change the voltage level.

The measured voltage is significant in the system. This is because each row could have a different voltage, each indicating how many of the dimples are depressed. In a preferred embodiment, look-up tables are used by the CPU boards 53 to determine, based on the measured voltages, which switches are closed. In a given row with N dimples depressed, there could be the column's dimple resistance $R_D$ in series with a parallel combination of N−1 dimple resistances and the row pull down resistance. If all of the values are equal to a value R, then this equals to R in series with a parallel combination of N resistors R. The voltage measured at the row is then:

$$V_L + \frac{\frac{R}{N}}{R + R/N}(V_H - V_L)$$

If $V_L$ is zero, this simplifies to $$\frac{V_H}{(N+1)}.$$

This will be the voltage measured on any row connected to a column which is high.

The highest load on a column of conductors 34 or a row of conductors 36 will occur when all the pairs of contact points 38, 39 are connected by depressed dimples 26. In such a case, for each quarter of a floor tile 12, which is monitored by a QCP board 96, 64 switches will be connected, i.e. 64 pairs of contact points 38, 39 will be electrically connected. In a preferred embodiment, the high voltage used is five volts giving a voltage on a row, with all pairs of contract points 38, 39 connected, of 77 mV (i.e. 5V/(64+1)). Therefore, to detect the connection of each pair of contact points 38, 39 in a given row of conductors 36, for a given scanned column the voltage must be 77 mV or larger. A voltage near ground indicates that the pair of contact points 38, 39 are not connected by the corresponding contact area 28. Note that when the pair of contact points 38, 39 are not connected, the voltage on the corresponding row will not be exactly ground because the columns of conductors 34 cannot be pulled completely to ground.

To compare the measured voltages to the lookup table, each row of conductors 36, in one example, is connected to an analogue-to-digital converter (ADC). To facilitate that, analogue multiplexers are used to selectively connect each row to the ADC in turn. The microcontroller reads the ADC for each row and detects if the reading is above a threshold of approx. 50 mV—this helps the system work properly in electrically-noisy environments. This allows a determination of the number N associated with the voltage, this being the number of dimples depressed. This information for a given combination with measurements for preceding unconnected columns allows a determination of where in the row the N dimples are depressed. In another embodiment, no lookup table is employed, and if the voltage measured for a given row/column combination is larger than a given threshold, then a decision is made that the dimple was depressed. This requires analysis of the voltage of every row/column to determine the shape of the footprint.

Figure 5:
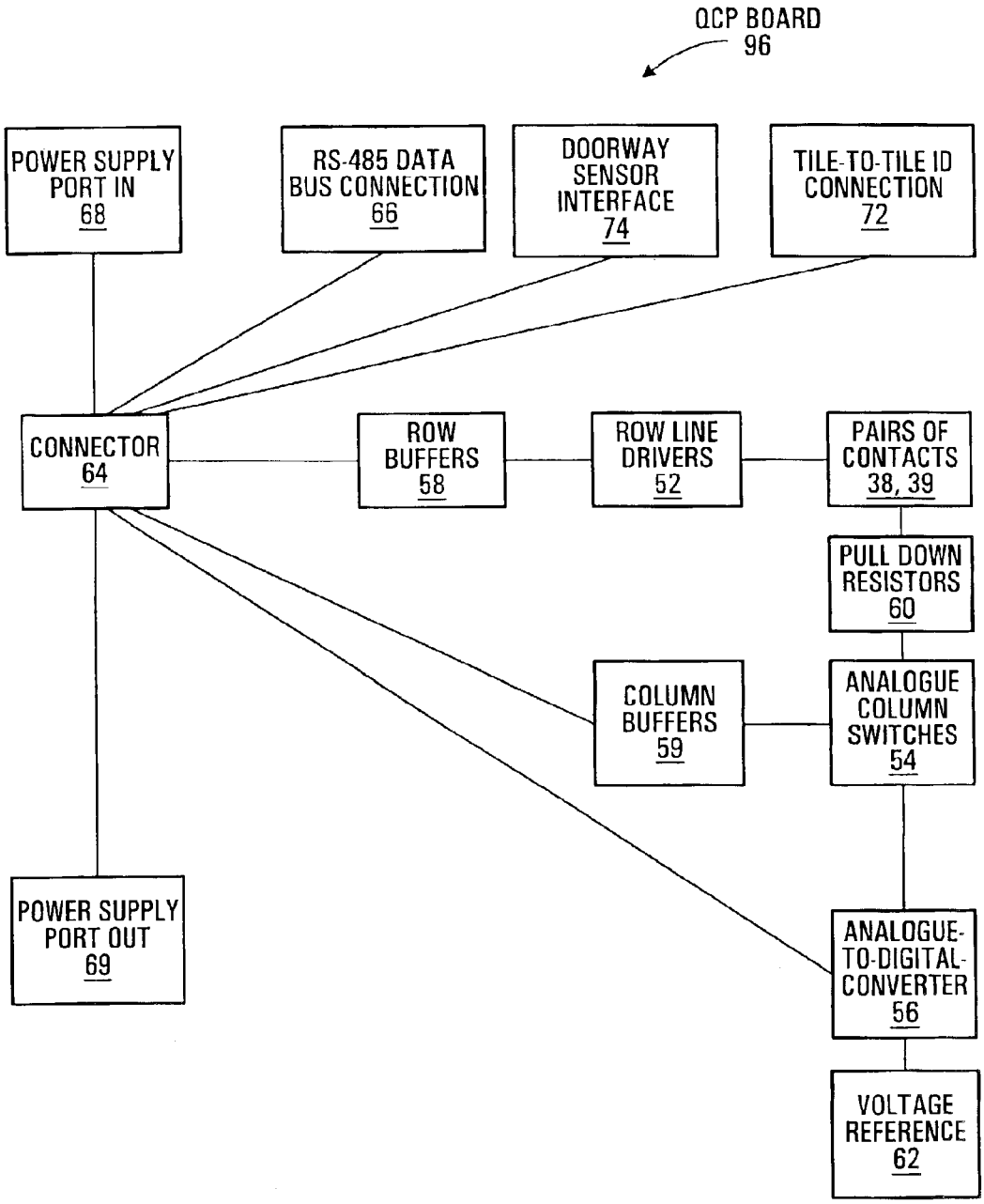
FIG. 5 is a block diagram of a quarter contact panel of a floor tile according to a preferred embodiment of the present invention.

The electronic portion of the floor tile 12 will now be described with reference to the block diagrams of FIGS. 5 and 6. The electronic portion of the floor monitoring system 10 is comprised of 5 printed circuit boards (PCBs), plus the connectors, and a power supply. The five PCBs are comprised of one CPU board 53 plus four identical QCP boards, 96. The CPU board 53 is mounted in the centre of the tile under the four QCP boards 96 in the cavity 44 of the tile base 40. The QCP boards 96 are preferably connected to the CPU board 53 through a 44-pin connector at one corner of the QCP boards 96. Each QCP board 96 is rotated by 0, 90, 180, or 270 degrees depending on which quadrant of the tile it occupies. A description of the functions of each board follows. It will be understood that the elements and their features defined below are directed to one embodiment. Equivalents can be substituted without deviating from the invention.

Figure 6:
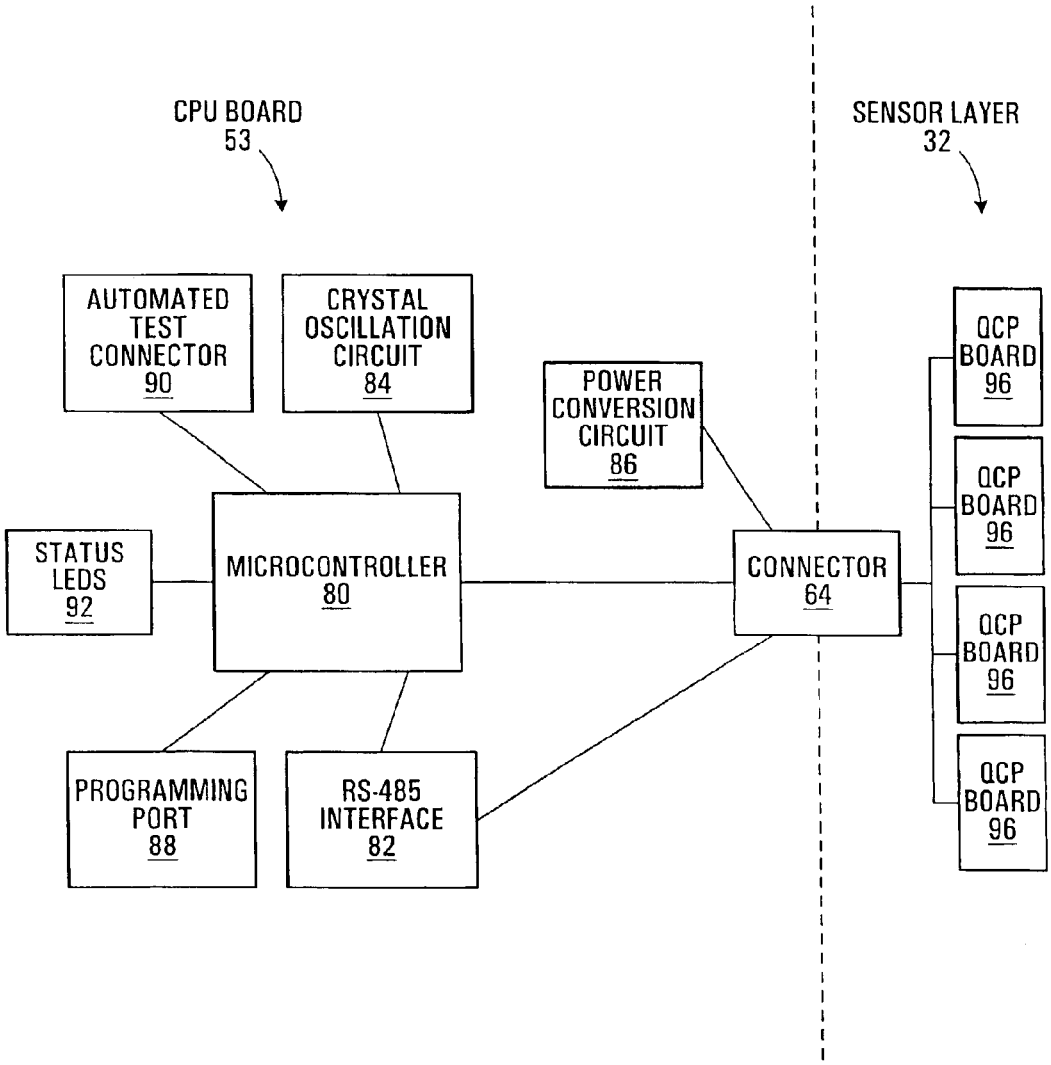
FIG. 6 is a block diagram of a central processing unit of a floor tile according to a preferred embodiment of the present invention.

The CPU board 53 contains the following subsystems shown schematically in FIG. 6:

a) A microcontroller 80—The microcontroller 80 contains a microchip PIC-series device and associated circuitry. The PIC-series device contains CPU, static RAM, non-volatile program data, high-speed communication ports, a plurality of input/output ports, and several other internal peripherals. The microcontroller 80 will control all functions of the tile and communicate with the central processing computer 16 though the RS-485 interface 82 via the connector 64.

b) A crystal oscillation circuit 84—The crystal oscillation circuit 84 provides a stable oscillator for the microcontroller 80 to ensure stable high-speed operation. The speed of oscillation is adjustable by simply changing the values of the components.

c) A power conversion circuit 86—The power conversion circuit 86 is based on a switching power supply controller plus support circuitry. The power conversion circuit 86 provides power for all electronic components of the CPU board 53 and the four QCP boards 96 via the connector 64. It preferably provides up to 1A of 5V DC power. It operates with an input voltage preferably from 8 to 30 volts, allowing a wide range of power supplies to be used. The wide input voltage range also provides correct operation due to voltage drops at the end of a 100-piece tile system. A single floor tile 12 preferably requires only 300 mA of 5V power—the remainder can be used for the doorway sensor 20 or other external device.

d) A programming port 88—The programming port 88 allows the operating firmware of the microcontroller 80 to be updated, providing support both for development as well as production upgrades.

e) An automated test connector 90—The automated test connector 90 will preferably allow almost complete automated testing of an assembled CPU board 53. Automated tests will include power supply tests with varying input voltages, CPU operation, RS-485 communication, simulation of QCP connections for full system tests, and others. This port can also be used for system testing and verification of a completed tile, either during manufacturing or after installation.

f) The RS-485 interface 82—The RS-485 interface 82 subsystem is a single integrated circuit that provides all required RS-485 functionality. It is connected to a bi-directional communication port on the microcontroller 80 and to the RS-485 data bus connection 66 on one QCP board 96 via the connector 64.

g) Status LEDs 92—The two status LEDs 92 can be used for test and development purposes, as well as for diagnostic tests of an installed floor tile 12.

Each QCP board 96 acts in parallel with the others. Each QCP board 96 contains the following subsystems shown in the block diagram of FIG. 5:

a) The pairs of contact points 38, 39—Each QCP board 96 contains a grid of preferably 64×64 pairs of contact points 38, 39 for a total of 16384 pairs of contact points 38, 39 on each floor tile 12. They are preferably equi-spaced at 0.1875 inches apart.

b) Row line drivers 52—The row line drivers 52 enable, preferably, one row of conductors 36 at a time by setting the voltage high, preferably to 5V. This setting instruction is coordinated one row at a time by the microcontroller 80.

c) Analogue column switches 54—The analogue column switches 54 connect to each conductor in the columns of conductors 34 and switch each conductor into the analogue-to-digital converter 56, under the microcontroller 80 control. This setting instruction is coordinated one column at a time by the microcontroller 80.

d) Row buffer drivers 58 and column buffer drivers 59—The row buffer drivers 58 and the column buffer drivers 59 are used to ensure that the microcontroller's 80 outputs can effectively drive all required devices on all 4 QCP boards 96. The row buffer drivers 58 and the column buffer drivers 59 store the commands from the microcontroller 80 and feed them through to the row line drivers 52 and the analogue column switches 54 leaving the microcontroller 80 free to control other QCP boards 96.

e) Pull-down resistors 60 on each column of conductors 34 are also used to bias the voltage into the analogue column switches 54.

f) The Analogue-to-digital converter 56—the analogue-to-digital converter 56 is a four channel device. Each channel is used to read 64 column voltages in sequence. It is preferably an 8-bit device with a conversion speed of 1 megasample per second. The voltages are measured by the analogue-to-digital converter 56 for each pair of contact points 38, 39 and are transmitted back to the microcontroller 80 via the connector 64.

g) A voltage reference 62—The voltage reference 62 uses an accurate and stable 2.5V voltage reference with output circuitry to bring the reference voltage down to 0.5V. This reference voltage is fed into the analogue-to-digital converter 56.

h) A connector 64—The Connector 64 is a 44-pin connector and connects the row buffers 58 and the column buffers 59 and the analogue-to-digital converter 56 to the microcontroller 80. It also connects the CPU board 53 to a power supply port-in 68, the RS-485 data bus connection 66, the doorway sensor interface 74 and the tile-to-tile connection 72. When not connected to the CPU board 53 it can be used for automated tests during manufacture, as well as in-field diagnostics.

i) The power supply port-in 68 and the power supply port-out 69—The power supply port-in 68 is a 2-pin port which allows DC voltage up to 28V to be brought into the floor tile 12, passed into the power conversion circuit 86 on the CPU board 53, via the connector 64, where it is passed out to the other QCP boards 96 and then passed out of the power supply port-out 69 on another QCP board to the next floor tile 12 in the sequence.

j) An RS-485 data bus connection 66—The RS-485 data bus connection 66 is a 2-pin port which provides the connection to the RS-485 bus back to the RS-485 interface 82 on the CPU board 53 via the connector 64.

k) A tile-to-tile ID connection 72—The tile-to-tile ID connection 72 is a 2-pin port which connects the tile identification pins to the neighbouring tiles. These connections are fed to the CPU board 53 via the connector 64. Every tile has a tile-to-tile connection to its nearest neighbours.

l) A doorway sensor interface 74—The doorway sensor interface 74 is a 4-pin connector which provides a connection mechanism to the external doorway sensor 20. It contains a 5V power supply pin, ground, and bi-directional serial communication pins. The doorway sensor interface 74 connects the doorway sensor 20 to the microcontroller 80 via the connector 64.

The floor tiles 12 are connected to each other by the connectors 47. The connectors 47 connect the floor tiles 12 mechanically and provide the electronic wires to connect the power supply ports 68, RS-485 bus connection 66 and tile-to-tile connection 72 on adjacent tiles. One of the connectors 47 is also used to connect the doorway sensor 20 to the doorway sensor interface 74. The connectors 47 may be either 2 or 4 pin devices. Each connector assembly is made from one PCB with several spring contacts. They are positioned in place during floor tile 12 installation.

The power supply preferably provides 24V DC power at up to 8 amps to power up to 100 tiles. It is a stand-alone system whose input connects to utility power and whose output connects to a first floor tile 12.

The bracelet system to be used is comparable but a simplified version of the system is described in Applicant's co-pending Canadian Patent Application No. 2,324,967. The bracelet 18 is a simple device generating a radio frequency identification (RF ID) signal at short range. The RF ID is detected by the doorway sensor, transmitted to the CPU board 53 in one of the floor tiles 12 and then back to the central procession computer 16. The bracelet system could alternatively us a swipe card system with a card reader. Swipe cards would have particular use in security applications where the floor monitoring system 10 could be used to verify the identity of the individual using the swipe card.

In operation, the floor monitoring system 10 operates as follows. The floor tiles 12 are assembled into a floor surface. As noted above, the floor tiles 12 can be completely assembled or can be lacking a surface layer which is assembled when the floor itself is assembled. The floor tiles 12 are interconnected by the connectors 47. The spacing of the connectors 47 is preferably different on different edges of the floor tiles 12 to ensure that the floor tiles 12 can only be connected in a correct orientation. Terminating connectors can also be installed at the edges of the floor system where no further floor tiles 12 will be connected. The floor tiles 12 are connected in turn to a Central Processing Computer. The power supply is also connected to the floor tiles 12 with a redundant connection. The doorway sensor interface 74 provides a 5V power supply pin for the doorway sensor 20.

Each floor tile 12 is connected to its nearest neighbour and knows the unique identification of its nearest neighbour. Upon power up, the central processing computer 16 polls all the floor tiles 12 to determine its nearest neighbour and maps their spatial location based upon their unique identification.

The CPU board 53 in each floor tile 12 scans the pairs of contacts 38, 39 sixty times per second to locate closed contacts caused by footsteps compressing the dimples. The extent of the footstep on each floor tile 12 is measured by the closed contacts and this information is transmitted back to the central processing computer 16.

The central processing computer 16 maintains a database of the footstep history of each individual who wears a bracelet 18. The central processing computer 16 is equipped to calculate numerous features from the data received including the cadence of the subject's gait, the time cycle of every stride, the foot contact for each foot, the foot contact mirror for one foot compared to the other foot, the foot volume, the time of initial contact for each step, etc. The doorway sensor 20 is connected to the CPU board 53 of one of the floor tiles 12 and the CPU board 53 transmits the doorway sensor 20 information to the central processing computer 16. When a subject enters a room the door sensor 20 will sense the identification of the individual from the bracelet 18 and this will be transmitted to the central processing computer 16. At the same time, data regarding the individual's footsteps is recorded from the floor tiles 12. This is done by the central processing computer 16, continually polling the CPU board 53 in each of the floor tiles 12 sixty times per second to ascertain contact information. Preferably, the floor tiles 12 will transmit an indication whether there is a change in status or not and only floor tiles 12 on which there has been a change will have their data supplied to the central processing computer 16. Multiple individuals can be tracked by the system using the footstep information from each tile and the RF ID from each bracelet when received by the doorway sensor 20 provided that the frequencies of their bracelets do not overlap. The central processing computer 16 is equipped to handle multiple transmissions.

The above description of a preferred embodiment should not be interpreted in any limiting manner since variations and refinements can be made without departing from the spirit of the invention. The scope of the invention is defined by the appended claims and their equivalents.

What is claimed is:

1. A floor monitoring tile comprising:

a contact layer having an upper surface and a lower surface, the lower surface having a plurality of conductive contacts;

a sensor layer having a plurality of first conductors and a plurality of second conductors, each first conductor having a plurality of first contact points and each second conductor having a plurality of second contact points, for each contact, of the plurality of conductive contacts, a respective first contact point of said first plurality of contact points and a respective second contact point of said second plurality of contact points forming a set being aligned with the contact;

wherein for each contact, when no force is applied to the contact, the respective first contact point and the respective second contact point remain electrically isolated and when force is applied to the contact, the respective first contact point and the respective second contact point electrically connect through the contact.

2. A floor monitoring tile according to claim 1 further comprising a base upon which the contact layer and the sensor layer are mounted, the base having a power line for receiving power from and transmitting power to at least one neighbor tile, and a data bus for receiving data from and transmitting data to the neighbor tile.

3. A floor monitoring tile according to claim 1 further comprising a detector for detecting whether each first conductor and each second conductor are electrically isolated or electrically connected.

4. A floor monitoring tile according to claim 1 wherein the contact layer is comprised of a sheet of nonconductive resilient flexible material.

5. A floor monitoring tile according to claim 1 further comprising a surface layer of resilient flexible material for accepting the force on an outer surface and which flexes in a direction of the force to transmit the force to the upper surface of the contact layer.

6. A floor monitoring tile according to claim 1 wherein each contact electrically connects a respective first contact point of said first plurality of contact points and a respective second contact point of said second plurality of contact points through a respective known resistance.

7. A floor monitoring tile comprising:

a contact layer having an upper surface and a lower surface, the lower surface having a plurality of conductive contacts;

a sensor layer having a plurality of first conductors and a plurality of second conductors, each first conductor having a plurality of first contact points and each second conductor having a plurality of second contact points, for each contact, of the plurality of conductive contacts, a respective first contact point of said first plurality of contact points and a respective second contact point of said second plurality of contact points forming a set being aligned with the contact;

wherein for each contact, when no force is applied to the contact, the respective first contact point and the respective second contact point remain electrically isolated and when force is applied to the contact, the respective first contact point and the respective second contact point electrically connect through the contact, wherein each contact comprises a dimple defined in a resilient flexible material, each dimple having a spacing nonconductive portion and an inner conductive portion both facing the sensor layer wherein, when the force is not applied to the contact, the spacing nonconductive portion of the dimple insulates the inner conductive portion from contact with the sensor layer and when force is applied to the contact, the spacing nonconductive portion collapses thereby bringing the inner conductive portion into contact with the sensor layer.

8. The floor monitoring tile according to claim 7 wherein the inner conductive portion of the dimple possesses a known resistance.

9. A floor monitoring tile according to claim 6 wherein each of the first conductors overlap each of the second conductors and each of the contact is proximal to a point of overlap.

10. A floor monitoring tile according to claim 3 wherein the sensor layer is defined on at least one first printed circuit board and the detector is defined on a second printed circuit board wherein the first and the second printed circuit boards are electrically connected.

11. A floor monitoring tile according to claim 3 wherein the detector detects whether each first conductor and each second conductor are electrically connected by measuring the voltage on each first conductor when a high voltage is applied to each second conductor in turn.

12. A floor monitoring tile according to claim 7 further comprising a detector which detects whether each first conductor and each second conductor are electrically connected by applying a voltage to each first conductor in turn, measuring an output voltage on each second conductor when the voltage is applied to each first conductor, and using the voltage measurements to determine a set of depressed dimples.

13. A floor monitoring system comprising a plurality of floor monitoring tiles according to claim 11 and a processing system which calculates where on a tile the force is applied based both on a measurement of a number and location of connections made between each first and each second conductor and the resistance of each connection.

14. A system for monitoring the movements of at least one individual across a floor surface comprising:

a plurality of floor tiles;

the floor tiles each having an upper surface, a contact layer, a sensor layer and a detector;

the contact layer having a plurality of conductive contacts; and the sensor layer comprising a plurality of pairs of contact points which are electrically connected by the conductive contacts of the contact layer when force is applied normal to the contact points;

wherein the detector calculates an area of the floor tile over which the force is applied as a function of time.

15. The system of claim 14 further comprising a monitor electrically connected to the floor tiles, wherein the monitor communicates with the floor tiles and retrieves the information from the detector.

16. A system for monitoring the movements of at least one individual across a floor surface comprising:

a plurality of floor tiles;

the floor tiles each having an upper surface, a contact layer, a sensor layer and a detector;

the contact layer having a plurality of conductive contacts; and the sensor layer comprising a plurality of pairs of contact points which are electrically connected by the conductive contacts of the contact layer when force is applied normal to the contact points;

a transmitter worn by an individual for emitting an identification signal;

at least one receiver placed adjacent the floor tiles;

the receiver being electrically connected to at least one floor tile;

wherein the detector calculates an area of the floor tile over which the force is applied as a function of time; and the receiver is capable of receiving the identification signal and transmitting the identification signal to the at least one floor tile.

17. The system of claim 16 wherein the transmitter is housed within a bracelet, broach, necklace, other personal accessory, a swipe card or an implant.

18. The system of claim 15 further comprising a database and a processor wherein the database contains sets of information concerning a plurality of individuals and the processor is adapted to correlate the sets of stored information with the information received by the monitor when an identification signal is registered.

19. The system according to claim 16 wherein the monitor is adapted to monitor a plurality of individuals.

20. The system of claim 18 wherein at least one individual of the plurality of individuals is under medical care and the processor is adapted to compare the set of stored information with the information received by the monitoring means.

21. The system of claim 14 wherein the floor tiles each comprise: a contact layer having an upper surface and a lower surface, the lower surface having a plurality of conductive contacts;

a sensor layer having a plurality of first conductors and a plurality of second conductors, each first conductor having a plurality of first contact points and each second conductor having a plurality of second contact points, for each contact, of the plurality of conductive contacts, a respective first contact point of said first plurality of contact points and a respective second contact point of said second plurality of contact points forming a set being aligned with the contact;

wherein for each contact, when no force is applied to the contact, the respective first contact point and the respective second contact point remain electrically isolated and when force is applied to the contact, the respective first contact point and the respective second contact point electrically connect through the contact.

* * * * *